United States Patent [19]

Granetzke et al.

[11] Patent Number: 4,862,953

[45] Date of Patent: Sep. 5, 1989

[54] HEAT EXCHANGER MOUNTING BRACKET

[75] Inventors: Dennis Granetzke; Thomas H. Matter, both of Racine, Wis.

[73] Assignee: Modine Manufacturing Company, Racine, Wis.

[21] Appl. No.: 188,202

[22] Filed: Apr. 29, 1988

[51] Int. Cl.[4] ..... F28F 9/00

[52] U.S. Cl. ..... 165/67; 180/68.4; 248/213.3; 248/233

[58] Field of Search ..... 165/67, 76; 180/68.4; 248/213.3, 213.4, 232, 233

[56] References Cited

U.S. PATENT DOCUMENTS

| | | | |
|---|---|---|---|
| 1,056,553 | 3/1913 | Kehm | 165/67 X |
| 1,805,887 | 5/1931 | Russell | 180/68.4 |
| 3,042,352 | 7/1962 | Stamper . | |
| 3,132,831 | 5/1964 | Stamper . | |
| 3,160,204 | 12/1964 | Jones . | |
| 3,180,597 | 4/1965 | Havener . | |
| 3,233,851 | 2/1966 | Lemieux et al. . | |
| 3,325,128 | 6/1967 | Elleboudt . | |
| 3,544,049 | 12/1970 | Brown et al. . | |
| 3,565,385 | 2/1971 | Zurawski . | |
| 3,894,580 | 7/1975 | Chartet . | |
| 3,920,887 | 11/1975 | Kloos et al. . | |
| 4,231,421 | 11/1980 | Eaton et al. . | |
| 4,621,682 | 11/1986 | Jennings et al. . | |
| 4,688,311 | 8/1987 | Saperstein et al. | 29/157.3 R |

FOREIGN PATENT DOCUMENTS

| | | | |
|---|---|---|---|
| 7412767 | 9/1975 | Netherlands | 165/67 |

*Primary Examiner*—Randall L. Green

*Attorney, Agent, or Firm*—Wood, Dalton, Phillips Mason & Rowe

[57] ABSTRACT

A mounting bracket for a heat exchanger of the type defined by a core having tubes and fins assembled together. The mounting bracket is adapted to extend between a pair of spaced plates between which the core is disposed. A first securing mechanism is associated with a first end of the mounting bracket. It is adapted to cooperate with one of the plates for interlocked pivotal movement of the mounting bracket relative to the other of the plates. The first securing mechanism accommodates movement from a position where the second end of the mounting bracket is spaced from the other of the plates to a position where the second end of the mounting bracket is adjacent the other of the plates. A second securing mechanism is associated with a second end of the mounting bracket. It is adapted to cooperate with the other of the plates for locked engagement of the mounting bracket to the other of the plates. The mounting bracket is adapted to cooperate with the plates after the tubes and fins have been assembled together to form the core. With this arrangement, the mounting brackets are not subject to shifts in location or loss of temper and strength that could otherwise occur during brazing operations.

22 Claims, 2 Drawing Sheets

HEAT EXCHANGER MOUNTING BRACKET

FIELD OF THE INVENTION

The present invention generally relates to heat exchangers and, more particularly, to mounting brackets for heat exchangers.

BACKGROUND OF THE INVENTION

Generally speaking, mounting brackets for heat exchangers are fixtured preliminary to brazing operations. This is true for a variety of heat exchangers including radiators, condensers and oil coolers. For instance, fixtured brackets are commonly utilized in parallel flow heat exchangers.

In this connection, it has been proposed for certain applications to utilize parallel flow heat exchangers wherein a plurality of parallel tubes extend between headers. Each of the tubes in such an arrangement defines a plurality of parallel flow paths within its innards. With this construction, relatively small individual passages can be utilized which in turn reduces the percentage of the total frontal area of the device occupied by the tubes.

However, forming tubes to contain a plurality of parallel flow paths has presented a number of difficulties, particularly where the flow paths are intended to have a small hydraulic diameter. Economical extrusion techniques have not yet been developed and where inserts are utilized to subdivide the interior of the tube, difficulty has been met. More specifically, this has presented the problem of maintaining the structural integrity of the assemblage to prevent tube rupture at conventional operating pressures.

While this problem has been addressed in commonly owned U.S. Pat. No. 4,688,311, other problems remain in connection with such heat exchangers. Notably, for all heat exchangers, but particularly parallel flow heat exchangers such as radiators, condensers and oil coolers, fixtured brackets which are subjected to a brazing operation have been subject to shifts in location and have been known to lose most of their temper and strength. Of course, this is most undesirable in maintaining the structural integrity of the assemblage particularly as it relates to the tubes, fins and headers.

Accordingly, the present invention is directed to overcoming one or more of the above problems.

SUMMARY OF THE INVENTION

It is the principal object of the invention to provide a new and improved mounting bracket for a heat exchanger. More specifically, it is an object of the invention to provide a mounting bracket having a first mechanical securing means at one end thereof and a second mechanical securing means at the other end thereof. It is a further object of the present invention for the securing means to mechanically cooperate with a pair of spaced plates.

The foregoing objects are accomplished in a heat exchanger which includes a mounting bracket together with a core having tubes and fins assembled together where the core is disposed between a pair of spaced plates spanned by the mounting bracket The mounting bracket includes first securing means associated with a first end thereof and second securing means associated with a second end thereof. The first securing means is adapted to cooperate with one of the plates for interlocked pivotal movement of the mounting bracket relative to the other of the plates. The first securing means accommodates movement from the position where the second end of the mounting bracket is spaced from the other of the plates to a position where the second end of the mounting bracket is adjacent the other end of the plates. The second securing means is adapted to cooperate with the other of the plates for locked engagement of the mounting bracket with the other of the plates. The mounting bracket is adapted to cooperate with the plates after the tubes and fins have been assembled together to form the core. In a preferred embodiment, the mounting bracket is utilized in a parallel flow heat exchanger such as a radiator, condenser or oil cooler.

In such an embodiment, the core has a pair of parallel headers with alternating rows of tubes and fins all assembled together by brazing. The core is disposed between a pair of spaced parallel plates extending generally parallel to the tubes and fins where at least one of the plates includes a rear flange and the other of the plates includes a front flange. The rear flange preferably includes a notch adapted to cooperate with a pair of oppositely projecting ears associated with the first end of the mounting bracket for engagement with the rear flange on opposite sides of the notch. The front flange preferably includes an opening adapted to receive a projection associated with the second end of the mounting bracket which extends through and cooperates with the opening. The mounting bracket is thus adapted to be locked in position relative to the plates after the headers, tubes and fins have all been assembled together by brazing to form the core. Advantageously, the mounting bracket also includes means for mounting the heat exchanger to a supporting surface.

The invention contemplates that one of the plates is a top plate and the other of the plates is a bottom plate. The mounting bracket then includes an elongated bracket portion extending between the first and second ends thereof in confronting relation to a rear face of the core and the second end of the mounting bracket is defined by a flat bracket portion extending generally perpendicular to the elongated bracket portion so as to extend to the front flange in confronting relation to the bottom plate. The opening in the front flange of the bottom plate is then a slot and the projection associated with the second end of the mounting bracket is a tab extending from the flat bracket portion to extend through the slot. Preferably, the tab is adapted to be folded, twisted, or to cooperate with a wear washer for locked engagement of the mounting bracket in a fixed position relative to the plates.

Other objects and advantages of the present invention will become apparent from the following specification taken in conjunction with the accompanying drawings.

DESCRIPTION OF THE PREFERRED EMBODIMENTS

Figure 1:
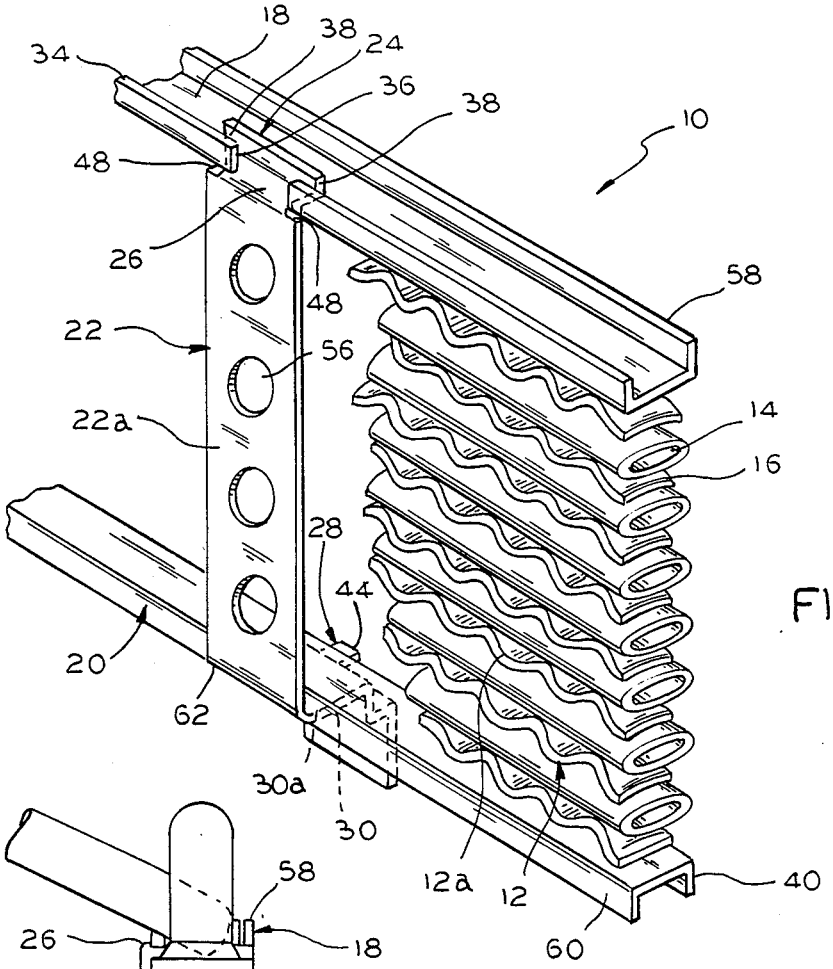
FIG. 1 is a perspective view of a portion of a heat exchanger which utilizes a mounting bracket in accordance with the present invention.

An exemplary embodiment of a heat exchanger made according to the invention is illustrated in the form of a radiator in FIG. 1. However, it is to be understood that the invention may be employed with efficacy in the manufacture and assembly of other heat exchangers, either of the parallel flow-type or otherwise, including but not limited to condensers and oil coolers. In fact, the invention may be employed with any heat exchanger which requires a mounting bracket for proper utilization.

Referring to FIG. 1, the heat exchanger generally designated 10 includes a core 12 having tubes 14 and fins 16 assembled together with the core 12 being disposed between a pair of spaced plates 18 and 20. A mounting bracket generally designated 22 is adapted to extend between or span the plates 18 and 20 substantially as shown. Also as shown, the mounting bracket 22 includes first securing means 24 associated with a first end 26 thereof and second securing means 28 associated with a second end 30 thereof.

Figure 2:
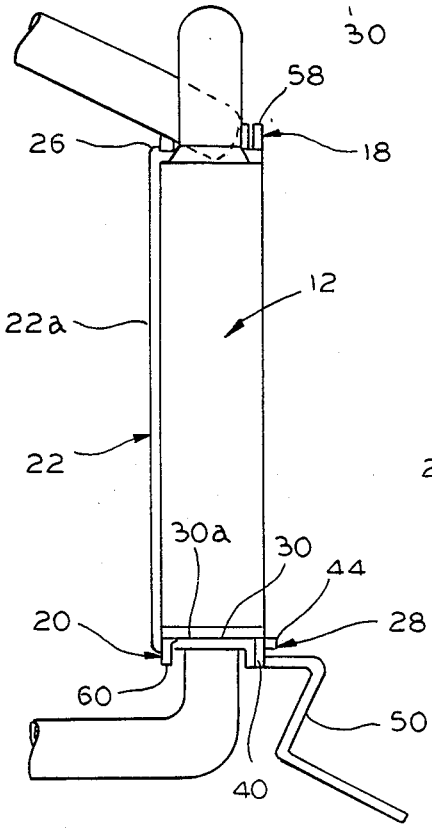
FIG. 2 is an end elevational view of the heat exchanger of FIG. 1.
Figure 2A:
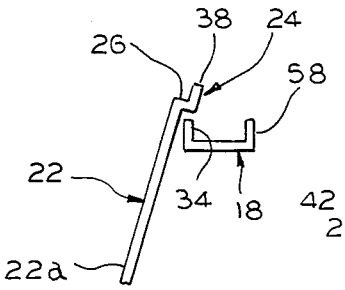
FIG. 2A is an enlarged detail view illustrating an initial step in assembly of the mounting bracket with the heat exchanger of FIG. 1.

Still referring to FIG. 1, the first securing means 24 is adapted to cooperate with one of the plates 18 for releasably interlocked pivotal movement of the mounting bracket 22 relative to the other of the plates 20 (see, also, FIG. 2A). It will be appreciated by comparing FIGS. 1, 2 and 2A, that the first securing means 24 accommodates movement from a position where the second end 30 of the mounting bracket 22 is spaced from the other of the plates 20 to a position where the second end 30 of the mounting bracket 22 is adjacent the other of the plates 20. Additionally, by referring to FIGS. 1, 2 and 2B, the second securing means 28 is adapted to cooperate with the other of the plates 20 for locked engagement of the mounting bracket 22 with the other of the plates 20.

Because of the unique construction of the present invention, the mounting bracket 22 is adapted to cooperate with the plates 18 and 20 after the tubes 14 and fins 16 have been assembled together to form the core 12. This is particularly advantageous in a parallel flow heat exchanger which includes a core having a pair of parallel headers such as header 32 (see FIG. 4) with alternating rows of tubes 14 and fins 16 all assembled together by brazing. In such an assembly, the core 12 is disposed between a pair of spaced parallel plates such as 18 and 20 extending generally parallel to the tubes 14 and fins 16.

Figure 4:
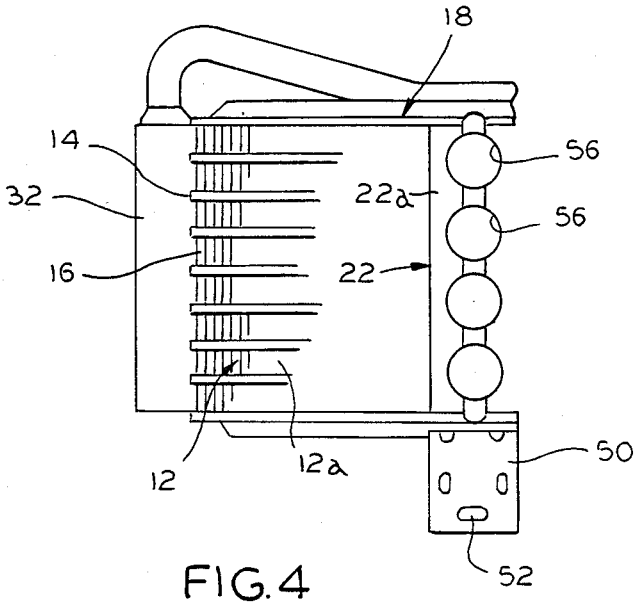
FIG. 4 is a partial front elevational view of a mounting bracket and heat exchanger in accordance with the present invention.

As will be appreciated from all of FIGS. 1, 2 and 4, the elongated mounting bracket 22 is adapted to extend between the spaced parallel plates 18 and 20 in close proximity to a rear face **12*a* of the core 12. The first securing means 24 is adapted to mechanically cooperate with a rear flange 34 of one of the plates 18 for releasably interlocked pivotal movement of the mounting bracket 22 relative to the other of the plates 20. The rear flange 34 includes a notch 36 and the first securing means 24 includes a pair of oppositely projecting ears 38 associated with the first end 26 of the mounting bracket 22 for engagement with the rear flange 34 on opposite sides of the notch 36. The first securing means 24 accommodates movement of the mounting bracket 22 to a position where the second end 30 thereof is adjacent or in engagement with the other of the plates 20. The second securing means 28 is adapted to mechanically cooperate with a front flange 40 of the other of the plates 20 for locked engagement of the mounting bracket 22 in a fixed position relative to the plates 18 and 20. The front flange 40 includes an opening 42 (see FIG. 2B) and the second securing means 28 includes a projection 44 associated with the second end 30 of the mounting bracket 22 to extend through and cooperate with the opening 42. With this arrangement, the mounting bracket 22 is adapted to be locked in position relative to the plates 18 and 20 after the headers such as 32, tubes 14 and fins 16 have all been assembled together, for instance, by brazing to form the core 12**.

In the embodiment illustrated in the drawings, the heat exchanger 10 includes horizontally extending tubes 14 and fins 16, vertically extending headers such as 32, and horizontally extending plates 18 and 20. With this arrangement, the one of the plates 18 is a top plate and the other of the plates 20 is a bottom plate and the headers such as 32 are vertically oriented and spaced apart at opposite sides of the core 12. Also, as shown in the drawings, the mounting bracket 22 includes an elongated vertically extending bracket portion **22*a* extending between the first and second ends 26 and 28 in confronting relation to the rear face 12*a* of the core 12**.

Figure 3:
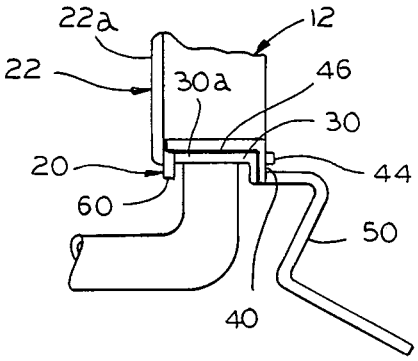
FIG. 3 is a detail view illustrating another feature for the mounting bracket and heat exchanger of FIG. 1.

As will be appreciated from FIGS. 1, 2 and 3, the second end 30 of the mounting bracket 22 is defined by a flat bracket portion **30*a* which extends generally perpendicular to the elongated bracket portion 22*a*. The flat bracket portion 30*a* is of a sufficient length so as to extend to the front flange 40 and is positioned so as to be in confronting relation to the bottom plate 20. Preferably, the projection 44 comprises a tab extending from the flat bracket portion 30*a* of the mounting bracket 22 and a corrosion resisting insulating strip 46 is disposed between the flat bracket portion 30*a* and the bottom plate 20**.

In the embodiment illustrated in FIG. 1, the first end 26 of the mounting bracket 22 preferably includes a notch 48 on each side thereof to define the oppositely projecting ears 38. It will also be appreciated that the first end 26 of the mounting bracket 22 is defined by a first 90° bend toward the top plate 18 and a second 90° bend vertically away from the surface of the top plate 18. As shown, the notches 48 are disposed in the first 90° bend so as to extend through the notch 36 in the rear flange 34 to position the oppositely projecting ears 38 on the opposite side thereof.

Figure 2B:
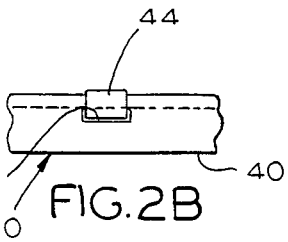
FIG. 2B is an enlarged detail view illustrating another aspect of assembly of the mounting bracket with the heat exchanger of FIG. 1.
Figure 2C:
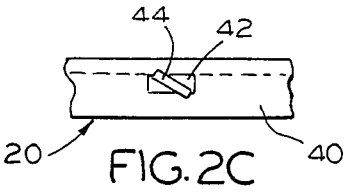
FIG. 2C is an enlarged detail view illustrating an alternative aspect of assembly of the mounting bracket with the heat exchanger of FIG. 1.
Figure 2D:
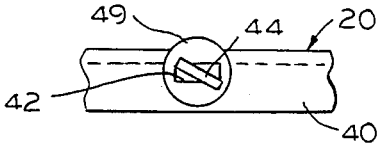
FIG. 2D is an enlarged detail view illustrating another alternative aspect of assembly of the mounting bracket with the heat exchanger of FIG. 1.

As will be appreciated by referring to FIG. 2B, the opening 42 in the front flange 40 of the bottom plate 20 is preferably a slot through which the projection or tab 44 associated with the flat bracket portion **30*a* is well suited to extend. With this arrangement, the tab 28 is adapted to be folded (FIG. 2B), twisted (FIG. 2C), or to cooperate with a wear washer 49 (FIG. 2D) for locked engagement of the mounting bracket 22 in a fixed position relative to the plates 18 and 20**.

Figure 2E:
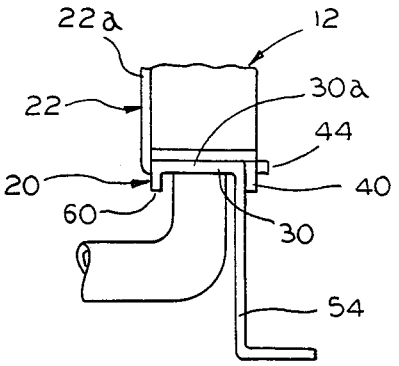
FIG. 2E is an enlarged detail view illustrating an alternative embodiment of the mounting bracket for the heat exchanger of FIG. 1.

As shown in FIGS. 2, 3 and 4, the mounting bracket 22 preferably includes means for mounting the heat exchanger 10 to a supporting surface which can take the form of a generally Z-shaped mounting flange 50 which may, for instance, have a fastener receiving opening 52 therein (see, also, FIG. 4). Alternatively, it may take the shape of simple L-shaped extension 54 (see FIG. 2E), or the mounting bracket 22 may simply be made to cooperate with a more intricate mounting bracket made and attached to it with any of these arrangements serving to attach the mounting bracket 22 and, thus, the entire heat exchanger 10 directly to another surface to hold the heat exchanger 10 in place. Also, the elongated bracket portion **22*a* preferably has a plurality of holes 56 therein (see FIG. 4) to avoid impeding air flow through the heat exchanger in the region of the mounting bracket 22** while reducing the overall weight and use of materials therein.

While not specifically shown, another advantage of the present invention can be appreciated by those skilled in the art having now been provided with an understanding of the features of the mounting bracket 22. Specifically, a plurality of the notches 36 in the rear flange 34 of the top plate 18 can be provided with a like plurality of correspondingly positioned openings 42 in the rear flange 40 of the bottom plate 20. With this arrangement, the applications engineer can choose from various locations for attachment of the mounting bracket 22 and there would be a resulting reduction in costs due to common tooling.

Finally, it will be noted that the top and bottom plates 18 and 20 have been illustrated as generally U-shaped channels in which case the top plate 18 will have not only a rear flange 34 but also a front flange 58 and, likewise, the bottom plate 20 will have not only a front flange 40 but a rear flange 60. In addition, in order to accept the 90° bend between the elongated bracket portion **22*a* and the flat bracket portion 30*a*, the rear flange 60 will include a notch such as 62 in the rear flange 60 whereby the flat bracket portion 30*a* can be disposed in engagement either directly with the bottom plate 20 or through the corrosion resisting insulating strip 46**.

While there have been set forth preferred embodiments of the invention for purposes of illustration, it will be appreciated by those skilled in the art that the details herein given may be varied without departing from the spirit and scope of the appended claims.

I claim:

1. In a heat exchanger including a core having tubes and fins assembled together where said core is disposed between a pair of spaced plates, the improvement comprising:

a mounting bracket adapted to extend between said plates, said mounting bracket including first mechanical securing means associated with a first end thereof and second mechanical securing means associated with a second end thereof, said first mechanical securing means being adapted to cooperate with one of said plates for releasably interlocked pivotal movement of said mounting bracket toward and away from said core, said first mechanical securing means accommodating pivotal movement of said mounting bracket from a position where said second end of said mounting bracket is spaced outwardly away from the other of said plates to a position where said second end of said mounting bracket is adjacent the other of said plates, said second mechanical securing means being adapted to cooperate with the other of said plates for locked engagement of said mounting bracket with the other of said plates after said second end of said mounting bracket has been pivotally moved adjacent thereto, said mounting bracket being adapted to cooperate with said plates after said tubes and fins have been assembled together to form said core, said mounting bracket including means for mounting said heat exchanger to a supporting surface.

2. The heat exchanger as defined by claim 1 wherein one of said plates has a rear flange, said first mechanical securing means being adapted to cooperate with said rear flange for releasably interlocked pivotal movement of said mounting bracket.

3. The heat exchanger as defined by claim 1 wherein one of said plates has a front flange, said second mechanical securing means being adapted to cooperate with said front flange for locked engagement of said mounting bracket.

4. In a parallel flow heat exchanger including a core having a pair of parallel headers with alternating parallel rows of tubes and fins extending therebetween and all assembled together by brazing where said core is disposed between a pair of spaced parallel plates extending generally parallel to said tubes and fins, the improvement comprising:

an elongated mounting bracket adapted to extend between said plates, said mounting bracket including first mechanical securing means associated with a first end thereof, one of said plates having a flange adapted to cooperate with said first mechanical securing means for releasably interlocked pivotal movement of said mounting bracket, said flange including a notch and said first mechanical securing means including a pair of oppositely projecting ears associated with said first end of said mounting bracket for engagement with said flange on opposite sides of said notch and said oppositely projecting ears engaging said flange to accommodate movement from a position where said second end of said mounting bracket is spaced from the other of said plates to a position where said second end of said mounting bracket is in engagement with other of said plates, the other of said plates also having a flange adapted to cooperate with said second mechanical securing means for locked engagement of said mounting bracket in a fixed position relative to said plates, said mounting bracket being adapted to cooperate with said plates after said headers, tubes and fins have all been assembled together by brazing to form said core, said mounting bracket also including means for mounting said heat exchanger to a supporting surface.

5. The parallel flow heat exchanger as defined by claim 4 wherein said front flange includes an opening and said second mechanical securing means includes a projecting associated with said second end of said mounting bracket to extend through and cooperate with said opening.

6. The parallel flow heat exchanger as defined by claim 5 wherein the one of said plates is a top plate and the other of said plates is a bottom plate, said mounting bracket including an elongated bracket portion extending between said first and second ends thereof.

7. The parallel flow heat exchanger as defined by claim 6 wherein said elongated bracket portion has a plurality of holes therein to avoid impeding air flow through said heat exchanger.

8. The parallel flow heat exchanger as defined by claim 6 wherein said second end of said mounting bracket is defined by a flat bracket portion extending generally perpendicular to said elongated bracket portion so as to extend to said front flange in confronting relation to said bottom plate.

9. The parallel flow heat exchanger as defined by claim 8 wherein said heat exchanger mounting means extends from said flat bracket portion of said mounting bracket.

10. The parallel flow heat exchanger as defined by claim 8 including a corrosion resisting insulating strip disposed between said flat bracket portion and said bottom plate.

11. In a parallel flow heat exchanger including a core having a pair of parallel headers with alternating parallel rows of tubes and fins extending therebetween and all assembled together by brazing where said core is disposed between a pair of spaced parallel plates extending generally parallel to said tubes and fins, the improvement comprising:

an elongated mounting bracket adapted to extend between said plates, said mounting bracket including first mechanical securing means associated with a first end thereof and second mechanical securing means associated with a second end thereof, said first mechanical securing means being adapted to cooperate with a rear flange on one of said plates for releasably interlocked pivotal movement of said mounting bracket relative to the other of said plates, said rear flange including a notch and said first mechanical securing means including a pair of oppositely projecting ears associated with said first end of said mounting bracket for engagement with said rear flange on opposite sides of said notch, said first mechanical securing means accommodating movement from a position where said second end of said mounting bracket is spaced from the other of said plates to a position where said second end of said mounting bracket is in engagement with the other of said plates, said second mechanical securing means being adapted to cooperate with a front flange on the other of said plates for locked engagement of said mounting bracket in a fixed position relative to said plates, said front flange including an opening and said second mechanical securing means including a projection associated with said second end of said mounting bracket to extend through and cooperate with said opening, said mounting bracket being adapted to be locked in position relative to said plates after said headers, tubes and fins have all been assembled together by brazing to form said core, said mounting bracket also including means for mounting said heat exchanger to a supporting surface.

12. The parallel flow heat exchanger as defined by claim 11 wherein said first end of said mounting bracket includes a notch on each side thereof to define said oppositely projecting ears.

13. The parallel flow heat exchanger as defined by claim 11 wherein the one of said plates is a top plate and the other of said plates is a bottom plate, said mounting bracket including an elongated bracket portion extending between said first and second ends thereof in confronting relation to a rear face of said core.

14. The parallel heat exchanger as defined by claim 13 wherein said elongated bracket portion has a plurality of holes therein to avoid impeding air flow through said heat exchanger.

15. The parallel flow heat exchanger as defined by claim 13 wherein said second end of said mounting bracket is defined by a flat bracket portion extending generally perpendicular to said elongated bracket portion so as to extend to said front flange in confronting relation to said bottom plate.

16. The parallel flow heat exchanger as defined by claim 15 wherein said heat exchanger mounting means extends from said flat bracket portion of said mounting bracket.

17. The parallel flow heat exchanger as defined by claim 15 including a corrosion resisting insulating strip disposed between said flat bracket portion and said bottom plate.

18. The parallel flow heat exchanger as defined by claim 15 including a plurality of said notches in said rear flange of said top plate and a plurality of said openings in said front flange of said bottom plate.

19. The parallel flow heat exchanger as defined by claim 15 wherein said opening in said front flange of said bottom plate is a slot and said projection of said second mechanical securing means is a tab extending from said flat bracket portion to extend through said slot.

20. The parallel flow heat exchanger as defined by claim 19 wherein said tab is adapted to be folded for locked engagement of said mounting bracket in a fixed position relative to said plates.

21. The parallel flow heat exchanger as defined by claim 19 wherein said tab is adapted to be twisted for locked engagement of said mounting bracket in a fixed position relative to said plates.

22. The parallel flow heat exchanger as defined by claim 19 wherein said tab is adapted to cooperate with a wear washer for locked engagement of said mounting bracket in a fixed position relative to said plates.

* * * * *